United States Patent [19]

Reddaway et al.

[11] 3,961,491

[45] June 8, 1976

[54] PILE CONNECTING DEVICE

[75] Inventors: Anthony Lewis Reddaway, Windlesham; Frank Edward Young, Sutton Courtenay, both of England

[73] Assignee: West's Piling and Construction Company Limited, Great Britain

[22] Filed: Mar. 14, 1975

[21] Appl. No.: 558,386

[30] Foreign Application Priority Data

Mar. 14, 1974 United Kingdom ..... 11427/74

[52] U.S. Cl. ..... 61/56; 52/726; 52/731; 403/282; 403/294

[51] Int. Cl.[2] ..... E02D 5/30; F16B 7/00

[58] Field of Search ..... 61/56, 53, 56.5; 403/294, 282; 52/726, 731, 733

[56] References Cited

UNITED STATES PATENTS

| | | | |
|---|---|---|---|
| 2,353,444 | 7/1944 | Conradty et al. | 403/294 X |
| 3,593,532 | 7/1971 | Grazel | 61/56 |
| 3,650,553 | 3/1972 | Wennstrom | 61/53 X |

FOREIGN PATENTS OR APPLICATIONS

| | | | |
|---|---|---|---|
| 152,032 | 10/1955 | Sweden | 61/56 |

*Primary Examiner*—Jacob Shapiro
*Attorney, Agent, or Firm*—Kane, Dalsimer, Kane, Sullivan and Kurucz

[57] ABSTRACT

A pile connecting device having a plurality of plate members each adapted to be secured to the end of a pile section and each having a recess extending inwardly from its periphery, frame means for operatively interconnecting said plate members, a further plurality of plate members each adapted to be secured to the end of a further pile section and each having a recess extending inwardly from its periphery, and a further frame means for operatively interconnecting said further plate members, each plate member prior to connection in with their recess registering, and a longitudinal pin substantially I-shaped in cross-section adapted to be inserted and retained in each pair of registering recesses, the underfaces of the heads of the pin bearing against the outer surfaces of the abutting plate members.

7 Claims, 8 Drawing Figures

PILE CONNECTING DEVICE

The present invention relates to pile connecting devices.

According to the present invention there is provided a pile connecting device, comprising a plurality of plate members each adapted to be secured to the end of a pile section and each having a recess extending inwardly from its periphery, frame means for operatively interconnecting said plate members, a further plurality of plate members each adapted to be secured to the end of a further pile section and each having a recess extending inwardly from its periphery, and a further frame means for operatively interconnecting said further plate members, said plate member adapted to bear against a further plate member prior to connection with their recesses registering, and a longitudinal pin substantially I-shaped in cross-section adapted to be inserted and retained in each pair of registering recesses, the underfaces of the heads of the pin bearing against the outer surfaces of the abutting plate members.

The present invention will now be more fully described by way of example, with reference to the accompanying drawings, wherein.

Figure 1:
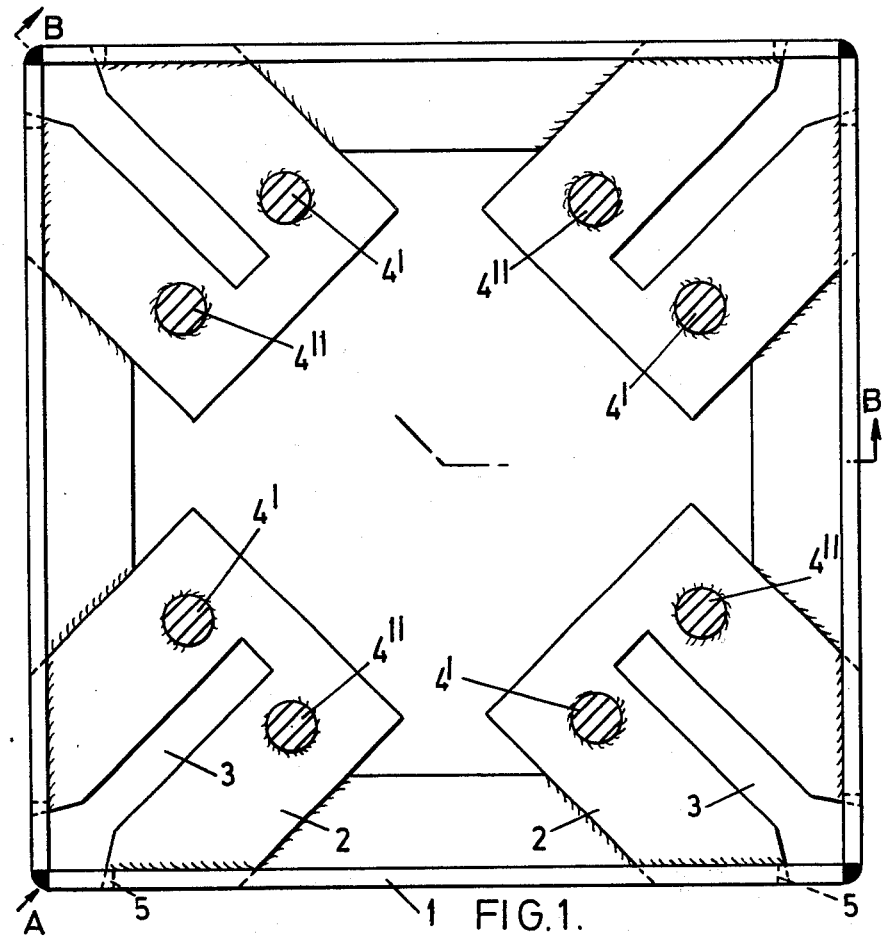
FIG. 1 is an end view of four plate members interconnected by a frame.
Figure 3:
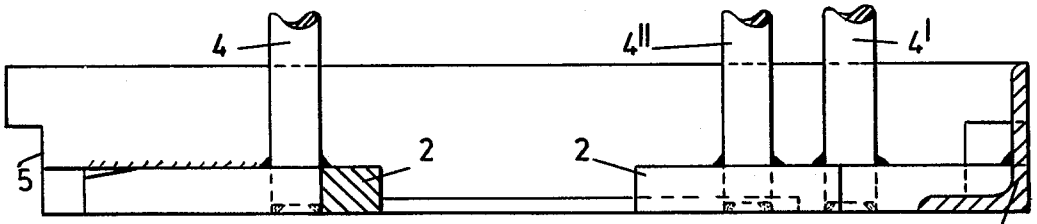
FIG. 3 is a section along the line B—B of FIG. 1.
Figure 6:
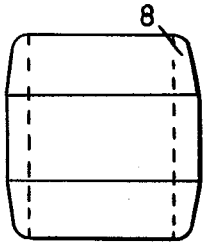
FIG. 6 shows a coupling.
Figure 4:
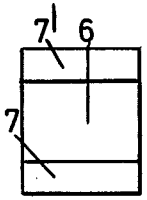
FIG. 4 is a side view of a locking pin.
Figure 5:
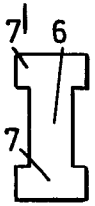
FIG. 5 is an end view of a locking pin.
Figure 2:
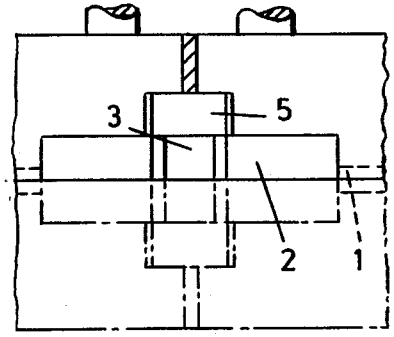
FIG. 2 is a view along the line A of FIG. 1.

In FIG. 1 there is shown a square frame 1, of angle metal to be fitted to a square shaped pile section. Connected to this frame 1 are four plate members 2 each having a recess 3 extending inwardly from its periphery and two reinforcement bars 4', 4'' of a pile section. Below the recesses 3 there is a channel recess 5 in the pile section and pins 6 having two heads, 7, 7' are drivable into this recess 5 and a similar recess in the pile section to be mounted on this pile section and thus hold together the adjacent ends of the two pile sections.

A coupling 8 is inserted into the end of one pile section so that, as the new pile section is lowered thereon, it has a recess to engage the coupling and thus centre the new pile section on the earlier pile section. The pile sections could have a central axial bore.

The number and shape of the plate members can vary.

Each pin 6 is of a length at least substantially equal to that of the portion of each recess having parallel side walls to provide a bearing area of pin to base plate member over substantially the whole pin head.

In an example the width of each side of the frame is 285 millimeters, the frame having a square shape. The reinforcement bars extend 800 millimeters into the pile section. The pile section has main reinforcement bars which, however, need not extend to the end surface and are not necessarily connected to the first said reinforcement bars or end plates. Clearly the pile section need not be square in which case the frame will be shaped to correspond with the shape of the pile section.

Clearly there could be one or three or more reinforcing bars connected to each plate.

The plates 2 have a square shaped inner end and the other end is pointed to form a protruding corner aligned with the corner edge of the pile section.

Preferably the slots extend from these pointed corners of the plates 2 although it is possible for the shape of the plates 2 to vary and the slots could be provided in other positions than at the corners.

In an embodiment the plates 2 have a thickness of 15 millimeters the stems of the pins 30 millimeters. The openings of the slots are chamfered to provide a wedge action as the pin is driven home.

In operation, as a pile section is driven into the ground, driving is stopped and another pile section is located end to end directly above the driven section. The new pile section is lowered until the four plates located at its corners make full planar contact with the four plates of the driven pile section and the slots in each pair of abutting plates are aligned alongside each other in parallel relationship to define a cavity extending inwards towards the centre of the pile from each of the four corners respectively.

The double-headed pins are then aligned so that the shank between the two heads enters the two parallel slots. The pins are then hammered home and serve to draw the two pile sections more tightly together.

The reinforcing bars need not be of steel.

Nuts 9 are provided to secure the pile section reinforcing bars to the plate members and a rigid bridge 10 is also provided connected between the reinforcing bars to maintain the reinforcing bars at a predetermined distance from one another and thus, prevent buckling of the plate members.

Figure 8:
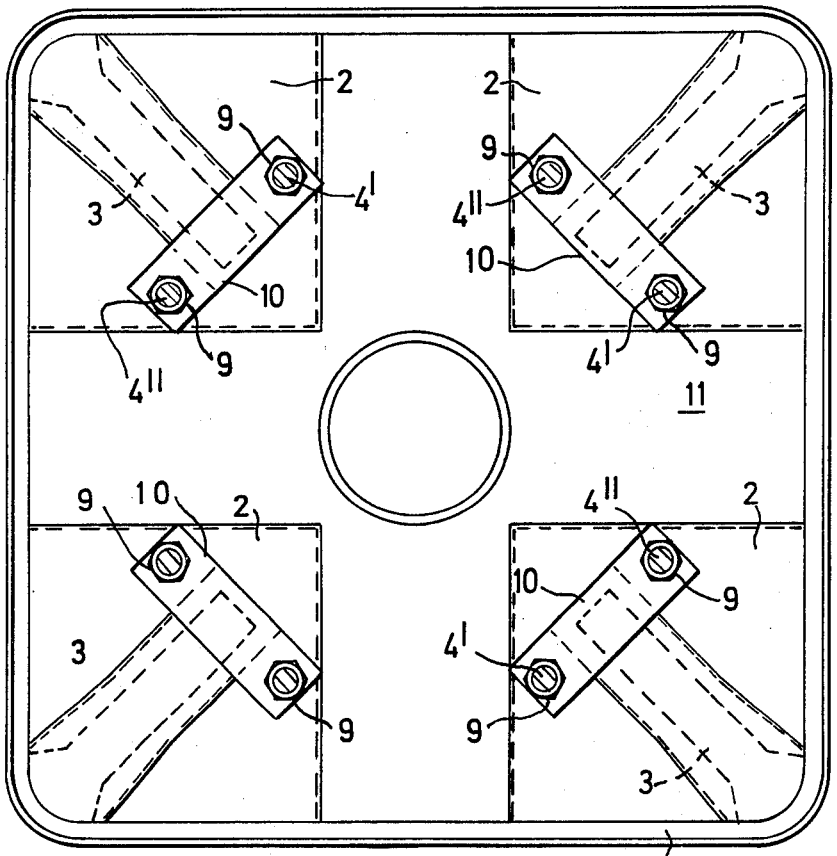
FIG. 8 is an end view of a further embodiment, illustrating four plate members and an interconnecting frame.
Figure 7:
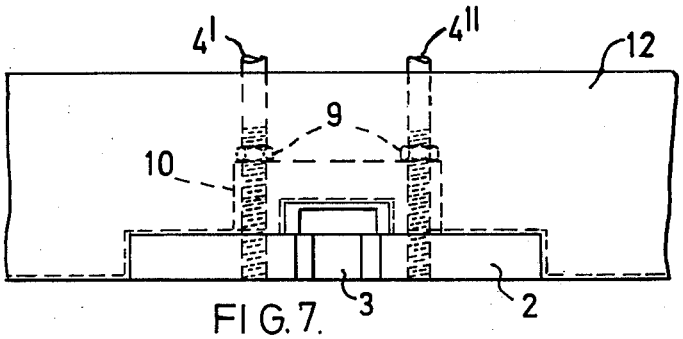
FIG. 7 is a view of a plate member and its frame means, illustrating a rigid bridge interconnecting two reinforcing rods of a pile section.

In the embodiment shown in FIG. 8 the frame means is a plate 11 having cut outs for the plate members, and side portions 12 adapted to lie against the sides of the pile section to form a skirt.

We claim:

1. A pile connecting device, comprising a plurality of plate members each adapted to be secured to the end of a first pile section and each having a recess extending inwardly from its periphery, first frame means for operatively interconnecting said plate members, a plurality of second plate members each adapted to be secured to the end of a second pile section and each having a recess extending inwardly from its periphery, and a second frame means for operatively interconnecting said second plate members, each of said first plate members adapted to bear against a corresponding one of said second plate members prior to connection of said first and second pile sections with the recesses in said corresponding first and second plate members registering, and a plurality of locking pins each of substantially I-shaped cross-section and adapted to be inserted and retained in one of said pairs of registering recesses, substantially the entire underfaces of the heads of each locking pin bearing against the outer surfaces of the abutting plate members.

2. A pile connecting device, as claimed in claim 1, wherein means are provided at opposite sides of the recess in each plate member to connect a pair of reinforcing bars in the pile section to each plate.

3. A pile connecting device, as claimed in claim 2, wherein a rigid bridge is provided between each pair of attached reinforcing bars to maintain said bars at a predetermined distance from one another.

4. A pile connecting device, as claimed in claim 1, wherein said frame means is rectangular and there are four plate members interconnected by said frame means.

5. A pile connecting device as claimed in claim 1, wherein said frame means is a plate adapted to be connected to the end of a pile section to form a skirt and having a plurality of cut-out portions each adapted to receive a plate member.

6. A pile connecting device as claimed in claim 1, wherein the peripheral portion of each plate member surrounding its recess is chamfered to facilitate feed-in of the leading end of said pin.

7. A pile connecting device as claimed in claim 1, wherein the side walls of each recess increasingly diverge along the outer edge portion of each recess.

* * * * *